US008695369B2

(12) United States Patent
Wu et al.

(10) Patent No.: US 8,695,369 B2
(45) Date of Patent: Apr. 15, 2014

(54) COMPRESSOR WITH VAPOR INJECTION SYSTEM

(75) Inventors: Man Wai Wu, Hong Kong (CN); Li Yi Zhang, Guangdong (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 202 days.

(21) Appl. No.: 13/237,154

(22) Filed: Sep. 20, 2011

(65) Prior Publication Data

US 2012/0006048 A1 Jan. 12, 2012

Related U.S. Application Data

(62) Division of application No. 11/209,182, filed on Aug. 22, 2005, now Pat. No. 8,037,710.

(51) Int. Cl.
*F25B 27/00* (2006.01)
*F25B 13/00* (2006.01)

(52) U.S. Cl.
USPC ..... 62/324.6; 62/324.4

(58) Field of Classification Search
USPC ..... 62/159, 160, 196.1, 228.5, 503, 324.4, 62/324.6, 434
See application file for complete search history.

(56) References Cited

U.S. PATENT DOCUMENTS

| | | | |
|---|---|---|---|
| 3,589,140 | A | 6/1971 | Osborne |
| 3,864,934 | A | 2/1975 | Jeding et al. |
| 3,871,187 | A | 3/1975 | Skvarenina |
| 3,913,346 | A | 10/1975 | Moody, Jr. et al. |
| 4,033,738 | A | 7/1977 | Merola et al. |
| 4,059,968 | A | 11/1977 | Ross |
| 4,062,199 | A | 12/1977 | Kasahara et al. |
| 4,369,633 | A | 1/1983 | Snyder |
| 4,370,868 | A | 2/1983 | Kim et al. |
| 4,439,114 | A | 3/1984 | Kimmell |
| 4,466,253 | A | 8/1984 | Jaster |

(Continued)

FOREIGN PATENT DOCUMENTS

| | | | |
|---|---|---|---|
| CN | 1626991 | A | 6/2005 |
| JP | 2003042585 | A | 2/2003 |
| JP | 2005172422 | A | 6/2005 |

OTHER PUBLICATIONS

First Office Action dated Jun. 26, 2009 received from the Chinese Patent Office regarding Application No. 200610092761, 7 Pages.

(Continued)

*Primary Examiner* — Chen Wen Jiang
(74) *Attorney, Agent, or Firm* — Harness, Dickey & Pierce, P.L.C.

(57) ABSTRACT

A heat pump system is provided and may include a compressor, a first heat exchanger in fluid communication with the compressor, a second heat exchanger in fluid communication with the first heat exchanger and the compressor, and a flash tank fluidly coupled to the first heat exchanger and the second heat exchanger. A first conduit may extend between the first heat exchanger and the second heat exchanger. A valve associated with the first conduit may operate in an open state to permit flow along the first conduit between the first heat exchanger and the second heat exchanger to at least partially bypass the flash tank and may operate in a closed state to prevent flow along the first conduit between the first heat exchanger and the second heat exchanger to direct flow into the flash tank.

21 Claims, 4 Drawing Sheets

(56) References Cited

U.S. PATENT DOCUMENTS

| | | | |
|---|---|---|---|
| 4,475,354 | A | 10/1984 | Akerhielm et al. |
| 4,573,327 | A | 3/1986 | Cochran |
| 4,665,716 | A | 5/1987 | Cochran |
| 4,831,843 | A | 5/1989 | Cochran |
| 4,899,555 | A | 2/1990 | Shaw |
| 5,069,043 | A | 12/1991 | Wachs, III et al. |
| 5,113,668 | A | 5/1992 | Wachs, III et al. |
| 5,189,885 | A | 3/1993 | Ni |
| 5,255,529 | A | 10/1993 | Powell et al. |
| 5,285,653 | A | 2/1994 | Meloling et al. |
| 5,431,026 | A | 7/1995 | Jaster |
| 5,475,986 | A | 12/1995 | Bahel et al. |
| 5,515,694 | A | 5/1996 | Meloling et al. |
| 5,603,227 | A | 2/1997 | Holden et al. |
| 5,605,051 | A | 2/1997 | Iritani et al. |
| 5,678,761 | A | 10/1997 | Ikeda |
| 5,687,578 | A | 11/1997 | Cochran |
| 5,692,389 | A | 12/1997 | Lord et al. |
| 5,724,821 | A | 3/1998 | Lord et al. |
| 5,778,695 | A | 7/1998 | Ring et al. |
| 5,806,327 | A | 9/1998 | Lord et al. |
| 5,829,265 | A | 11/1998 | Lord et al. |
| 5,848,537 | A | 12/1998 | Biancardi et al. |
| 6,015,453 | A | 1/2000 | Haugen et al. |
| 6,018,958 | A | 2/2000 | Lingelbach et al. |
| 6,047,557 | A | 4/2000 | Pham et al. |
| 6,070,420 | A | 6/2000 | Biancardi et al. |
| 6,122,931 | A | 9/2000 | Paganessi et al. |
| 6,213,731 | B1 | 4/2001 | Doepker et al. |
| 6,233,962 | B1 | 5/2001 | Scherer et al. |
| 6,385,980 | B1 | 5/2002 | Sienel |
| 6,434,956 | B1 | 8/2002 | Ota et al. |
| 6,474,087 | B1 | 11/2002 | Lifson |
| 6,499,305 | B2 | 12/2002 | Pham et al. |
| 6,530,238 | B2 | 3/2003 | Hansen |
| 6,601,397 | B2 | 8/2003 | Pham et al. |
| 6,619,936 | B2 | 9/2003 | Perevozchikov |
| 6,745,584 | B2 | 6/2004 | Pham et al. |
| 7,275,385 | B2 | 10/2007 | Abel et al. |
| 7,299,649 | B2 * | 11/2007 | Healy et al. ..... 62/324.4 |
| 2005/0120733 | A1 | 6/2005 | Healy et al. |

OTHER PUBLICATIONS

The Second Office Action regarding Chinese Application No. 200610092761X received from the State Intellectual Property Office of People's Republic of China dated Feb. 12, 2010. Translation provided by Unitalen Attorneys at Law.

The Third Office Action regarding Chinese Patent Application No. 200610092761X received from the State Intellectual Property Office of People's Republic of China dated Jul. 12, 2010. Translation provided by Unitalen Attorneys at Law.

Non-Final Office Action in U.S. Appl. No. 11/209,182, dated Feb. 6, 2008.

Non-Final Office Action in U.S. Appl. No. 11/209,182, dated Jan. 2, 2009.

Non-Final Office Action in U.S. Appl. No. 11/209,182, dated Dec. 18, 2009.

Final Office Action in U.S. Appl. No. 11/209,182, dated Jun. 4, 2010.

Advisory Action in U.S. Appl. No. 11/209,182, dated Sep. 17, 2010.

Non-Final Office Action in U.S. Appl. No. 11/209,182, dated Dec. 14, 2010.

Korean Intellectual Property Office Notification of Grounds for Refusal regarding Korean Patent Application No. 10-2006-0047570, dated Dec. 15, 2012. English translation provided by Y.S. Chang & Associates.

* cited by examiner

COMPRESSOR WITH VAPOR INJECTION SYSTEM

CROSS-REFERENCE TO RELATED APPLICATIONS

This application is a divisional of U.S. patent application Ser. No. 11/209,182 filed on Aug. 22, 2005. The entire disclosure of the above application is incorporated herein by reference.

FIELD

The present teachings relate to vapor injection and, more particularly, to a heat pump system having an improved vapor injection system.

BACKGROUND

Heating and/or cooling systems including air-conditioning, chiller, refrigeration, and heat pump systems may include a flash tank disposed between a heat exchanger and the compressor for use in improving system capacity and efficiency. The flash tank receives liquid refrigerant from a heat exchanger and converts a portion of the liquid refrigerant into vapor for use by the compressor. Because the flash tank is held at a lower pressure relative to the inlet liquid refrigerant, some of the liquid refrigerant vaporizes, causing the remaining liquid refrigerant in the flash tank to lose heat and become sub-cooled. The resulting vapor within the flash tank is at an increased pressure and may be injected into the compressor to increase the heating and/or cooling capacity of the system.

The vaporized refrigerant from the flash tank is distributed to a medium or intermediate pressure input of the compressor. Because the vaporized refrigerant is at a substantially higher pressure than vaporized refrigerant leaving the evaporator, but at a lower pressure than an exit stream of refrigerant leaving the compressor, the pressurized refrigerant from the flash tank allows the compressor to compress this pressurized refrigerant to its normal output pressure while passing it through only a portion of the compressor.

The sub-cooled refrigerant disposed in the flash tank similarly increases the capacity and efficiency of the heat exchanger. The sub-cooled liquid is discharged from the flash tank and is sent to one of the heat exchangers depending on the desired mode (i.e., heating or cooling). Because the liquid is in a sub-cooled state, more heat can be absorbed from the surroundings by the heat exchanger, thereby improving the overall performance of the heating or cooling cycle.

The flow of pressurized refrigerant from the flash tank to the compressor is regulated to ensure that only vaporized refrigerant is received by the compressor. Similarly, flow of sub-cooled-liquid refrigerant from the flash tank to the heat exchanger is regulated to inhibit flow of vaporized refrigerant from the flash tank to the heat exchanger. Both of the foregoing situations may be controlled by regulating the flow of liquid refrigerant into the flash tank. In other words, by regulating the flow of liquid refrigerant into the flash tank, the amount of vaporized refrigerant and sub-cooled-liquid refrigerant may be controlled, thereby controlling flow of vaporized refrigerant to the compressor and sub-cooled-liquid refrigerant to the heat exchanger.

SUMMARY

A heat pump system is provided and may include a compressor, a first heat exchanger in fluid communication with the compressor, a second heat exchanger in fluid communication with the first heat exchanger and the compressor, and a flash tank fluidly coupled to the first heat exchanger and the second heat exchanger. A first conduit may extend between the first heat exchanger and the second heat exchanger. A valve associated with the first conduit may operate in an open state to permit flow along the first conduit between the first heat exchanger and the second heat exchanger to at least partially bypass the flash tank and may operate in a closed state to prevent flow along the first conduit between the first heat exchanger and the second heat exchanger to direct flow into the flash tank.

In another configuration, a vapor injection system is provided. The vapor injection system may be associated with a heat pump system that circulates refrigerant between a first heat exchanger and a second heat exchanger in a fluid circuit including a compressor. The vapor injection system may include a flash tank and a first conduit. The first conduit may fluidly couple an inlet of the flash tank to the first heat exchanger and the second heat exchanger and may deliver refrigerant to the flash tank from at least one of the first heat exchanger and the second heat exchanger. The vapor injection system may further include a second conduit extending between the first heat exchanger and the second heat exchanger that selectively delivers refrigerant from one of the first heat exchanger and the second heat exchanger to the other of the first heat exchanger and the second heat exchanger to at least partially bypass the flash tank.

Further areas of applicability of the present teachings will become apparent from the detailed description provided hereinafter. It should be understood that the detailed description and specific examples are intended for purposes of illustration only and are not intended to limit the scope of the teachings.

DRAWINGS

The present teachings will become more fully understood from the detailed description and the accompanying drawings, wherein.

DETAILED DESCRIPTION

Figure 1:
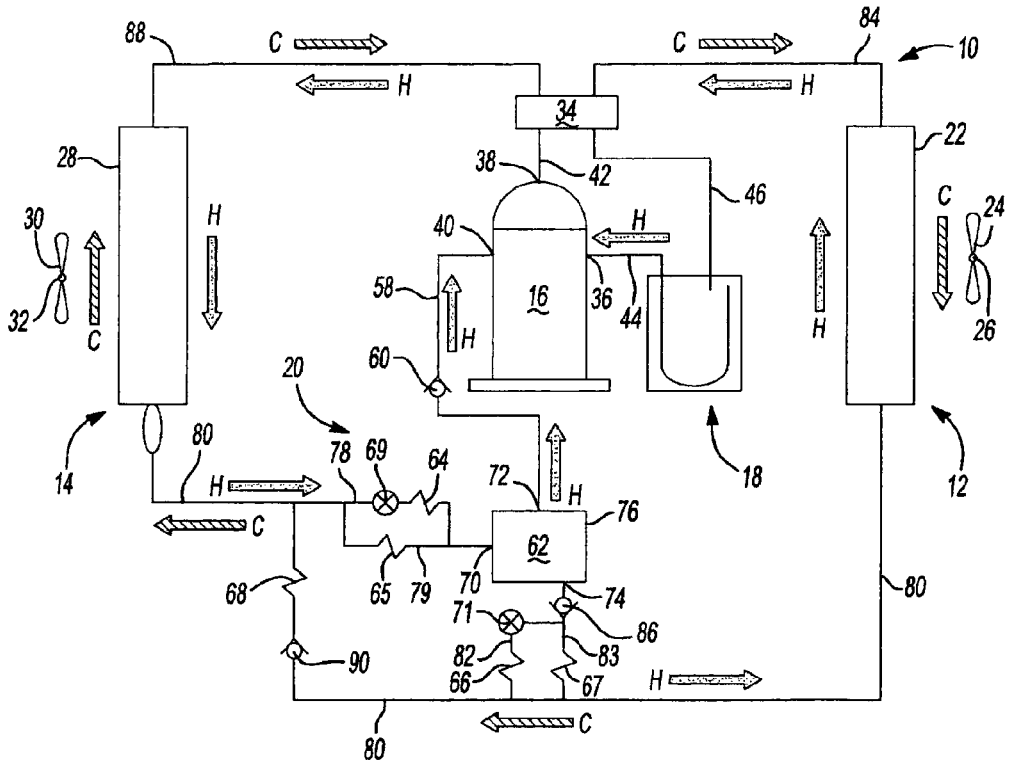
FIG. 1 is a schematic view of a heat pump system in accordance with the principles of the present teachings.

The following description is merely exemplary in nature and is in no way intended to limit the teachings, application, or uses.

Vapor injection may be used in air-conditioning, chiller, refrigeration and heat pump systems to improve system capacity and efficiency. Vapor injection systems may include a flash tank for vaporizing refrigerant supplied to a compressor and sub-cooling refrigerant supplied to a heat exchanger. Vapor injection may be used in heat pump systems, which are capable of providing both heating and cooling to commercial and residential buildings, to improve one or both of heating and cooling capacity and efficiency.

For the same reasons, flash tanks may be used in chiller applications to provide a cooling effect for water, in refrigeration systems to cool an interior space of a display case or refrigerator, and in air-conditioning systems to affect the temperature of a room or building. While heat pump systems may include a cooling cycle and a heating cycle, chiller, refrigeration and air-conditioning systems often only include a cooling cycle. However, heat pump chillers, which provide a heating and cooling cycle, are the norm in some parts of the world. Each system uses a refrigerant to generate the desired cooling or heating effect through a refrigeration cycle.

For air-conditioning applications, the refrigeration cycle is used to lower the temperature of the new space to be cooled, typically a room or building. For this application, a fan or blower is typically used to force the ambient air into more rapid contact with the evaporator to increase heat transfer and cool the surroundings.

For chiller applications, the refrigeration cycle cools or chills a stream of water. Heat pump chillers use the refrigeration cycle to heat a stream of water when operating on HEAT mode. Rather than using a fan or blower, the refrigerant remains on one side of the heat exchanger while circulating water or brine provides the heat source for evaporation. Heat pump chillers often use ambient air as the heat source for evaporation during HEAT mode but may also use other sources such as ground water or a heat exchanger that absorbs heat from the earth. Thus, the heat exchanger cools or heats the water passing therethrough as heat is transferred from the water into the refrigerant on COOL mode and from the refrigerant into the water on HEAT mode.

In a refrigeration system, such as a refrigerator or refrigerated display case, the heat exchanger cools an interior space of the device and a condenser rejects the absorbed heat. A fan or blower is often used to force the air in the interior space of the device into more rapid contact with the evaporator to increase heat transfer and cool the interior space.

In a heat pump system, the refrigeration cycle is used to both heat and cool. A heat pump system may include a second heat exchanger and an first heat exchanger, and the second heat exchanger both heats and cools a room or an interior space of a commercial or residential building. The heat pump may also be of a monobloc construction with the "outdoor" and "indoor" parts combined in one frame.

As described previously, the refrigeration cycle is applicable to air conditioning, chiller, heat pump chiller, refrigeration, and heat pump systems. While each system has unique features, vapor injection may be used to improve system capacity and efficiency. That is, in each system, a flash tank receiving liquid refrigerant from a heat exchanger and converting a portion of the liquid refrigerant into vapor, may be supplied to a medium or intermediate pressure input of the compressor. The vaporized refrigerant is at a higher pressure than vaporized refrigerant leaving the evaporator, but at a lower pressure than an exit stream of refrigerant leaving the compressor. The pressurized refrigerant from the flash tank, therefore, allows the compressor to compress this pressurized refrigerant to its normal output pressure while passing it through only a portion of the compressor. Further, the subcooled refrigerant in the flash tank is useful to increase the capacity and efficiency of the heat exchanger.

Because the liquid discharged from the flash tank is subcooled, when supplied to the heat exchanger, more heat can be absorbed from the surroundings, increasing overall performance of the heating or cooling cycle. More specific examples will be provided next with reference to the drawings, but one of skill in the art should recognize that while the examples described in this application include air conditioning and heating, the teachings are applicable to other systems and certain features described with respect to a particular type of system may be equally applicable to other types of systems.

With reference to FIG. 1, a heat pump system 10 is provided and includes a first heat exchanger 12, a second heat exchanger 14, a scroll compressor 16, an accumulator tank 18, and a vapor injection system 20. The first and second heat exchangers 12, 14 are in fluid communication with the scroll compressor 16, accumulator tank 18, and vapor injection system 20 such that a refrigerant may circulate therebetween. The refrigerant cycles through the system 10 under pressure from the scroll compressor 16 and circulates between the first and second heat exchangers 12, 14 to reject and absorb heat. As can be appreciated, whether the first heat exchanger 12 or the second heat exchanger 14 rejects or accepts heat will depend on whether the heat pump system 10 is set to a COOL mode or a HEAT mode, as will be discussed further below.

The first heat exchanger 12 includes a first coil or heat exchanger 22 and first fan 24 driven by a motor 26, which may be a single-speed, two-speed, or variable-speed motor. The first heat exchanger 12 includes a protective housing that encases the coil 22 and fan 24 so that the fan 24 will draw ambient air across the coil 22 to improve heat transfer. In addition, the first heat exchanger 12 usually houses the scroll compressor 16 and accumulator tank 18. While a fan 24 is disclosed, it should be understood that in a chiller application, heat is transferred from a stream of water directly to the refrigerant and, as such, may obviate the need for the fan 24. While first heat exchanger 12 has been described as including a fan 24 to draw ambient air across the coil 22, it should be understood that any method of transferring heat from the coil 22, such as burying the coil 22 below ground or passing a stream of water around the coil 22, is considered within the scope of the present teachings.

The second heat exchanger 14 includes a second coil or heat exchanger 28 and a second fan 30 driven by a motor 32, which may be a single-speed, two-speed, or variable-speed motor. The second fan 30 and coil 28 are enclosed in a cabinet so that the fan 30 forces ambient indoor air across the second coil 28 at a rate determined by the speed of the variable speed motor 32. Air flow across the coil 28 causes heat transfer between the ambient surroundings and the coil 28. In this regard, the coil 28, in conjunction with the second fan 30, selectively raises or lowers the temperature of the surroundings.

Again, while a fan 30 is disclosed, it should be understood that in a chiller application, heat is transferred from a stream of water directly to the refrigerant and, as such, may obviate the need for the fan 30. Furthermore, while the second heat exchanger 14 has been described as including a fan 30 to draw ambient air across the coil 28, it should be understood that any method of transferring heat from the coil 28, such as burying the coil 28 below ground or passing a stream of water around the coil 28, is considered within the scope of the present teachings.

Whether the fans 24, 30 are required for use with the first and second heat exchangers 12, 14 is largely dependent on the application of the first and second heat exchangers 12, 14. For example, if the first heat exchanger functions in a refrigeration system as a condenser, it may be advantageous to bury the coil 22 below ground rather than use a fan 24. However, in such a system burying the second heat exchanger 14, rather than using a fan 30, would not be advantageous as the second heat exchanger 14 functions as an evaporator and would therefore likely use a fan 30 to circulate air though coil 28 to cool an interior space of a refrigerator or refrigerated case (neither shown).

The heat pump system 10 is designated for both cooling and heating by simply reversing the function of the second coil 28 and the first coil 22 via a four-way reversing valve 34. Specifically, when the four-way valve 34 is set to the COOL mode, the second coil 28 functions as an evaporator coil and the first coil 22 functions as a condenser coil. Conversely, when the four-way valve 34 is switched to the HEAT mode (the alternate position), the function of the coils 22, 28 is reversed, i.e., the second coil 28 functions as the condenser and the first coil 22 functions as the evaporator.

When the second coil 28 acts as an evaporator, heat from the ambient-indoor surroundings is absorbed by the liquid refrigerant moving through the second coil 28. Such heat transfer between the second coil 28 and the liquid refrigerant cools the surrounding indoor air. Conversely, when the second coil 28 acts as a condenser, heat from the vaporized refrigerant is rejected by the second coil 28, thereby heating the surrounding indoor air.

The scroll compressor 16 may be housed within the first heat exchanger 12 and pressurizes the heat pump system 10 such that refrigerant is circulated throughout the system 10. The scroll compressor 16 includes a suction port 36, a discharge port 38, and a vapor injection port 40. The discharge port 38 is fluidly connected to the four-way valve 34 by a conduit 42 such that pressurized refrigerant may be distributed to the first and second heat exchangers 12, 14 via four-way valve 34. The suction port 36 is fluidly coupled to the accumulator tank 18 via conduit 44 such that the scroll compressor 16 draws refrigerant from the accumulator tank 18 for compression.

The scroll compressor 16 receives refrigerant at the suction port 36 from the accumulator tank 18, which is fluidly connected to the four-way valve 34 via conduit 46. In addition, the accumulator tank 18 receives refrigerant from the first and second heat exchangers 12, 14 for compression by the scroll compressor 16. The accumulator tank 18 stores low-pressure refrigerant received from the first and second coils 22, 28 and protects the compressor 16 from receiving refrigerant in the liquid state.

The vapor injection port 40 is fluidly coupled to the vapor injection system 20 via conduit 58 and receives pressurized refrigerant from the vapor injection system 20. A check valve 60 may be provided on conduit 58 generally between the vapor injection port 40 and the vapor injection system 20 to prevent refrigerant from flowing from the vapor injection port 40 to the vapor injection system 20.

The vapor injection system 20 produces pressurized vapor at a higher-pressure level than that supplied by the accumulator tank 18, but at a lower pressure than produced by the scroll compressor 16. After the pressurized vapor reaches a heightened pressure level, the vapor injection system 20 may deliver the pressurized refrigerant to the scroll compressor 16 via vapor injection port 40. By delivering pressurized-vapor refrigerant to the scroll compressor 16, system capacity and efficiency may be improved. Such an increase in efficiency may be even more pronounced when the difference between the outdoor temperature and the desired indoor temperature is relatively large (i.e., during hot or cold weather).

With reference to FIG. 1, the vapor injection system 20 is shown to include a flash tank 62, a pair of inlet expansion devices 64, 65, a pair of outlet expansion devices 66, 67, and a cooling expansion device 68. It should be noted that while each of the expansion devices 64, 65, 66, 67, 68 will be described as, and are shown as, capillary tubes, that the expansion devices 64, 65, 66, 67, 68 may alternatively be a thermal expansion valve or an electronic expansion valve. In addition, the vapor injection system 20 includes a first control valve 69 adjacent one of the inlet expansion devices 64, 65 and a second control valve 71 adjacent one of the outlet expansion devices 66, 67. While the control valves 69, 71 will be described hereinafter as solenoid valves, it should be understood that any control valve that is capable of selectively restricting refrigerant from capillary tubes 64, 66 is considered within the scope of the present teachings.

The flash tank 62 includes an inlet port 70, a vapor outlet 72, and a sub-cooled-liquid outlet 74, each fluidly coupled to an interior volume 76. The inlet port 70 is fluidly coupled to the first and second heat exchangers 12, 14 via conduits 78, 79, 80. The vapor outlet 72 is fluidly coupled to the vapor injection port 40 of the scroll compressor 16 via conduit 58 while the sub-cooled-liquid outlet 74 is fluidly coupled to the outdoor and second heat exchangers 12, 14 via conduits 82, 83, 80.

Figure 2:
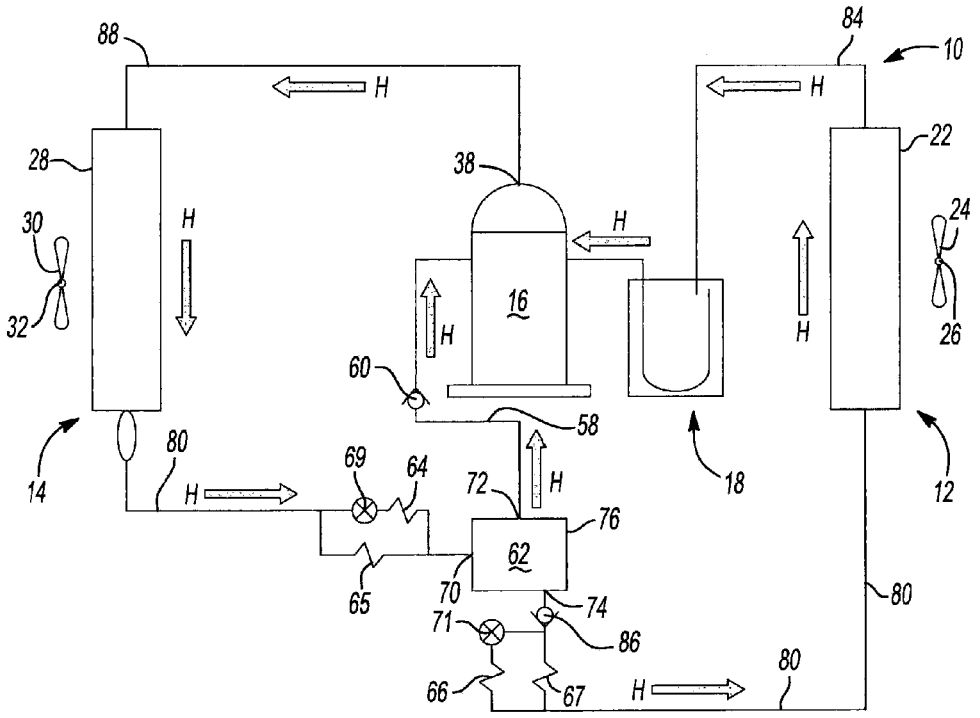
FIG. 2 is a schematic view of the heat pump system of FIG. 1 illustrating a HEAT mode.
Figure 3:
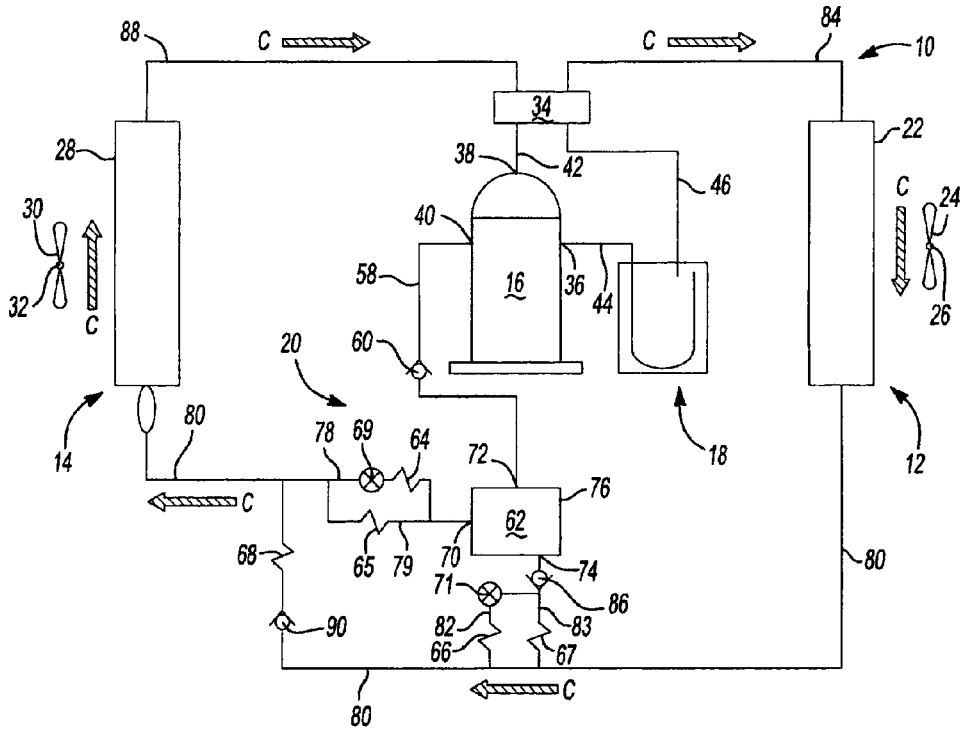
FIG. 3 is a schematic view of the heat pump system of FIG. 1 illustrating a COOL mode.

With particular reference to FIGS. 1-3, operation of the heat pump system 10 will be described in detail. The heat pump system 10 will be described as including a COOL mode and a HEAT mode with the vapor injection system 20 providing intermediate-pressure vapor and sub-cooled liquid refrigerant during the HEAT mode and bypassed in the COOL mode. It should be understood that while the vapor injection system 20 will be described hereinafter, and shown in the drawings, as being bypassed in the COOL mode, that the vapor injection system 20 could alternatively be bypassed in the HEAT mode by simply reversing the function of the first and second heat exchangers 12, 14, and thus the flow of refrigerant through the system 10.

When the heat pump system 10 is set to the COOL mode (FIG. 3), the vapor injection system 20 is bypassed such that vapor is not injected at the vapor injection port 40 of the compressor 16 and sub-cooled liquid refrigerant is not supplied to the second heat exchanger 28.

In the COOL mode, the scroll compressor 16 imparts a suction force on the accumulator tank 18 to draw vaporized refrigerant into the scroll compressor 16. Once the vapor is sufficiently pressurized, the high-pressure refrigerant is discharged from the scroll compressor 16 via discharge port 38 and conduit 42. The four-way valve 34 directs the pressurized refrigerant to the first heat exchanger 12 via conduit 84. Upon reaching the first coil 22, the refrigerant releases stored heat due to the interaction between the outside air, the coil 22, and the pressure imparted by the scroll compressor 16. After the refrigerant has released a sufficient amount of heat, the refrigerant changes phase from a gaseous or vaporized phase to a liquid phase.

After the refrigerant has changed phase from gas to liquid, the refrigerant moves from the first coil 22 to the second coil 28 via conduit 80. A check valve 86 is positioned along conduit 82 to prevent the liquid refrigerant from entering the flash tank 62 at outlet 74. Sub-cooled liquid refrigerant from the flask tank 62 does not mix with the liquid refrigerant from the first coil 22 as the liquid refrigerant from the first coil 22 is at a higher pressure than the sub-cooled liquid refrigerant.

Capillary tube 68 is disposed generally between the first heat exchanger 12 and the second heat exchanger 14 along conduit 80. The capillary tube 68 lowers the pressure of the liquid refrigerant due to interaction between the moving liquid refrigerant and the inner walls of the capillary tube 68. The lower pressure of the liquid refrigerant expands the refrigerant prior to reaching the second heat exchanger 14 and begins to transition back to the gaseous phase.

The lower-pressure refrigerant does not enter the flash tank 62 as the flash tank 62 is at a higher pressure than the refrigerant exiting the capillary tube 68. Therefore, when the system 10 is set to the COOL mode, refrigerant bypasses the flash tank 62 and vapor is not injected into the scroll compressor 16 at vapor injection port 40. Because refrigerant does not enter the flash tank 62 during the COOL mode, sub-cooled liquid refrigerant is not accumulated within the flash tank 62. Therefore, the second heat exchanger 14 does not receive sub-cooled liquid refrigerant during the COOL mode.

Upon reaching the second heat exchanger 14, the liquid refrigerant enters the second coil 28 to complete the transition from the liquid phase to the gaseous phase. The liquid refrigerant enters the second coil 28 at a low pressure (due to the interaction of the capillary tube 68, as previously discussed) and absorbs heat from the surroundings. As the fan 30 passes air through the second coil 28, the refrigerant absorbs heat and completes the phase change, thereby cooling the air passing through the second coil 28 and, thus, cooling the surroundings. Once the refrigerant reaches the end of the second coil 28, the refrigerant is in a low-pressure gaseous state. At this point, the suction from the scroll compressor 16 causes the refrigerant to return to the accumulator tank 18 via conduit 88 and four-way valve 34.

When the heat pump system 10 is set to the HEAT mode (FIG. 2), the vapor injection system 20 provides vapor at intermediate pressure to the vapor injection port 40 of the scroll compressor 16 and sub-cooled liquid refrigerant to the first heat exchanger 22.

In the HEAT mode, the scroll compressor 16 imparts a suction force on the accumulator tank 18 to draw vaporized refrigerant into the scroll compressor 16. Once the vapor is sufficiently pressurized, the high-pressure refrigerant is discharged from the scroll compressor 16 via discharge port 38 and conduit 42. The four-way valve 34 directs the pressurized refrigerant to the second heat exchanger 14 via conduit 88. Upon reaching the second coil 28, the refrigerant releases stored heat due to the interaction between the inside air, the coil 28, and the pressure imparted by the scroll compressor 16 and, as such, heats the surrounding area. Once the refrigerant has released a sufficient amount of heat, the refrigerant changes phase from the gaseous or vaporized phase to a liquid phase.

Once the refrigerant has changed phase from gas to liquid, the refrigerant moves from the second coil 28 to the first coil 22 via conduits 80, 78, and 79. The liquid refrigerant first travels along conduit 80 until reaching a check valve 90. The check valve 90 restricts further movement of the liquid refrigerant along conduit 80 from the second coil 28 to the first coil 22. In so doing, the check valve 90 causes the liquid refrigerant to flow into conduits 78, 79 and encounter solenoid valve 69 and capillary tube 65. The refrigerant further encounters capillary tube 64 if the solenoid valve 69 is in an open state.

The solenoid valve 69 is toggled into the open state to allow refrigerant to encounter capillary tube 64 when outdoor ambient conditions are high (i.e., when less heat is required indoor). When outdoor ambient conditions are high, more refrigerant enters the flash tank 62, as refrigerant is permitted to flow through both capillary tubes 64, 65. Allowing flow through both capillary tubes 64, 65 decreases resistance to flow and therefore increases the pressure of the refrigerant. Increasing the pressure of the refrigerant decreases the ability of the system 10 to heat and also prevents low evaporator temperature conditions as well as frost build-up on the first heat exchanger 22.

When outdoor ambient conditions are low, solenoid valve 69 is closed, directing all refrigerant through capillary tube 65 and bypassing capillary tube 64. Bypassing capillary tube 64 increases resistance to flow and therefore lowers the pressure of the refrigerant. Lowering the refrigerant pressure increases the ability of the system 10 to heat and is therefore useful during low outside ambient conditions.

It should be noted that in a system using the vapor injection system 20 during the COOL mode and bypassing the vapor injection system during the HEAT mode, that the solenoid valve 69 would be open when outdoor ambient conditions are low (i.e., when less cooling effect is required indoor). Conversely, in such a system, solenoid valve 69 would be closed when outdoor ambient conditions are high (i.e., when a greater cooling effect is required indoor).

The capillary tubes 64, 65 expand the refrigerant from the second coil 28 prior to the refrigerant entering the flash tank 62 at inlet 70. Expansion of the refrigerant causes the refrigerant to begin to transition from the liquid phase to the gaseous phase. As the liquid refrigerant flows through the inlet 70, the interior volume 76 of the flash tank 62 begins to fill. The entering liquid refrigerant causes the fixed interior volume 76 to become pressurized as the volume of the flash tank 62 is filled.

Once the liquid refrigerant reaches the flash tank 62, the liquid releases heat causing some of the liquid refrigerant to vaporize and some of the liquid to enter a sub-cooled-liquid state. At this point, the flash tank 62 has a mixture of both vaporized refrigerant and sub-cooled-liquid refrigerant. The vaporized refrigerant is at a higher pressure than that of the vaporized refrigerant leaving the first and second coils 22, 28 but at a higher pressure than the vaporized refrigerant leaving the discharge port 38 of the scroll compressor 16.

The vaporized refrigerant exits the flash tank 62 via the vapor outlet 72 and is fed into the vapor injection port 40 of the scroll compressor 16. The pressurized vapor-refrigerant allows the scroll compressor 16 to deliver an outlet refrigerant stream with a desired output pressure, thereby improving the overall efficiency of the system 10.

The sub-cooled-liquid refrigerant exits the flash tank 62 via outlet 74 and reaches the first heat exchanger 12 via conduits 82, 83, 80. The sub-cooled-liquid refrigerant leaves outlet 74 and encounters solenoid valve 71 and capillary tube 67. Capillary tube 67 expands the liquid refrigerant prior to reaching the first coil 22 to improve the ability of the refrigerant to extract heat from the outside. The refrigerant further encounters capillary tube 66 if the solenoid valve 71 is in an open state.

The solenoid valve 71 is toggled into the open state to allow refrigerant to encounter capillary tube 66 when outdoor ambient conditions are high (i.e., when less heat is required indoor). When outdoor ambient conditions are high, more refrigerant exits the flash tank 62, as refrigerant is permitted to flow through both capillary tubes 66, 67. Allowing flow through both capillary tubes 66, 67 decreases resistance to flow and therefore increases the pressure of the refrigerant. Increasing the pressure of the refrigerant decreases the ability of the system 10 to heat and also prevents low evaporator temperature conditions as well as frost build-up on the first heat exchanger 22.

When outdoor ambient conditions are low, solenoid valve 71 is closed, directing all refrigerant through capillary tube 67 and bypassing capillary tube 66. Bypassing capillary tube 66 increases resistance to flow and therefore lowers the pressure of the refrigerant. Lowering the refrigerant pressure increases the ability of the system 10 to heat and is therefore useful during low outside ambient conditions.

It should be noted that in a system using the vapor injection system 20 during the COOL mode and bypassing the vapor injection system during the HEAT mode, that the solenoid valve 71 would be open when outdoor ambient conditions are low (i.e., when less cooling effect is required indoor). Conversely, in such a system, solenoid valve 71 would be closed when outdoor ambient conditions are high (i.e., when a greater cooling effect is required indoor).

The solenoid valves 69, 71 may be used to provide the heat pump system with four configurations to tailor the capacity of the heat pump system 10 with the ambient conditions. For example, the solenoid valve 69 could be in a closed state with the solenoid valve 71 in the open state, solenoid valve 69 could be in the open state with the solenoid valve 71 in the closed state, both valves 69, 71 could be in the open state, and both valves 69, 71 could be in the closed state. The above-four valve combinations provide the heat pump system 10 with the ability to optimize capillary restriction based on outdoor ambient conditions.

As described, the heat pump system 10 includes a pair of solenoid valves 69, 71. However, it should be understood that the heat pump system 10 could alternatively include a single solenoid valve (i.e., either solenoid valve 69 or 71) to minimize the complexity of the system. Such a heat pump system 10 with a single solenoid valve disposed at either the inlet of the flash tank 62 (i.e., the position of solenoid valve 69) or a solenoid valve disposed at the outlet of the flash tank 62 (i.e., the position of solenoid valve 71) provides the heat pump system with two configurations to tailor the capacity of the heat pump system 10 with the ambient conditions.

Once the refrigerant absorbs heat from the outside via first coil 22, the refrigerant once again returns to the gaseous stage and return to the accumulator tank 18 via conduit 84 and four-way valve 34 to begin the cycle again.

Figure 4:
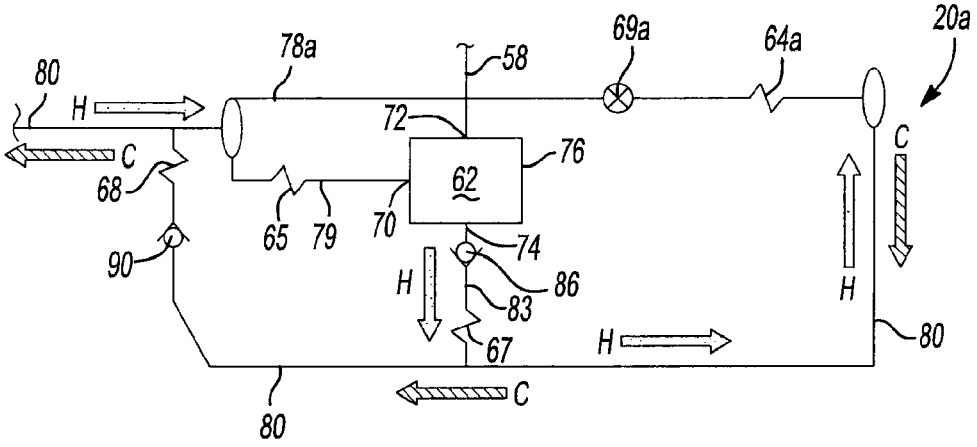
FIG. 4 is a schematic view of a vapor injection system in accordance with the principles of the present teachings for use with a heat pump system.

With reference to FIG. 4, a vapor injection system 20*a* is provided and may be used in place of the vapor injection system 20 shown in FIGS. 1-3. In view of the substantial similarity in structure and function of the components associated with the vapor injection system 20 with respect to the vapor injection system 20*a*, like reference numerals are used hereinafter and in the drawings to identify like components while like reference numerals containing letter extensions are used to identify those components that have been modified.

The vapor injection system 20*a* includes capillary tube 65 disposed proximate to inlet 70 of the flash tank 62 and capillary tube 67 disposed proximate to inlet 74 of the flash tank 62. Capillary tube 65 expands refrigerant prior to the refrigerant entering the flash tank 62 to facilitate vaporization while capillary tube 67 expands the sub-cooled liquid refrigerant to improve the ability of the refrigerant to absorb heat at the first heat exchanger 22.

The vapor injection system 20*a* also includes a solenoid valve 69*a* and an expansion device 64*a* disposed along a conduit 78*a* extending generally between conduit 80 and an inlet of the first heat exchanger 22. When the solenoid valve 69*a* is in an open state, the solenoid valve 69*a* allows refrigerant to encounter capillary tube 64*a* such that a portion of the refrigerant bypasses the flash tank 62. The solenoid valve 69*a* is toggled into the open state when outdoor ambient conditions are high (i.e., when less heat is required indoor).

When outdoor ambient conditions are high, refrigerant is directed through capillary tube 65 and into the flash tank 62 and also through capillary tube 64*a*. The refrigerant exiting capillary tube 65 is expanded by the capillary tube 65 prior to entering the flash tank 62. Once in the flash tank 62, the refrigerant is separated into a sub-cooled liquid refrigerant and an intermediate-pressure vapor and is used to increase the capacity of the system, as previously discussed.

The refrigerant exiting capillary tube 64*a* is similarly expanded and is piped directly into an inlet of the first heat exchanger 22. The refrigerant bypasses the flash tank 62 and is directly piped to the first heat exchanger 22. Allowing the refrigerant to flow through both capillary tubes 64*a*, 65 decreases the volume of refrigerant received by the flash tank 62 and increases the pressure of the refrigerant, thereby reducing the ability of the system to heat. Reducing the ability of the system to heat reduces the likelihood of liquid flood back and frost buildup on the first coil 22 when ambient conditions are high (i.e., when additional capacity is not required).

When outdoor ambient conditions are low, the solenoid valve 69*a* is closed such that all refrigerant is directed through capillary tube 65 and into the flash tank 62. Directing all refrigerant into the flash tank 62 increases the volume of refrigerant that reaches the flash tank 62 and decreases the pressure of the refrigerant, thereby increasing the overall ability of the system to heat as more intermediate-vapor reaches the compressor 16 and more sub-cooled liquid refrigerant reaches the first coil 22.

It should be noted that in a system using the vapor injection system 20*a* during the COOL mode and bypassing the vapor injection system during the HEAT mode, that the solenoid valve 69*a* would be open when outdoor ambient conditions are low (i.e., when less cooling effect is required indoor) to decrease the ability of the heat pump system to cool. Conversely, in such a system, solenoid valve 69*a* would be closed when outdoor ambient conditions are high (i.e., when more cooling effect is required indoor) to increase the ability of the heat pump system to cool.

Figure 5:
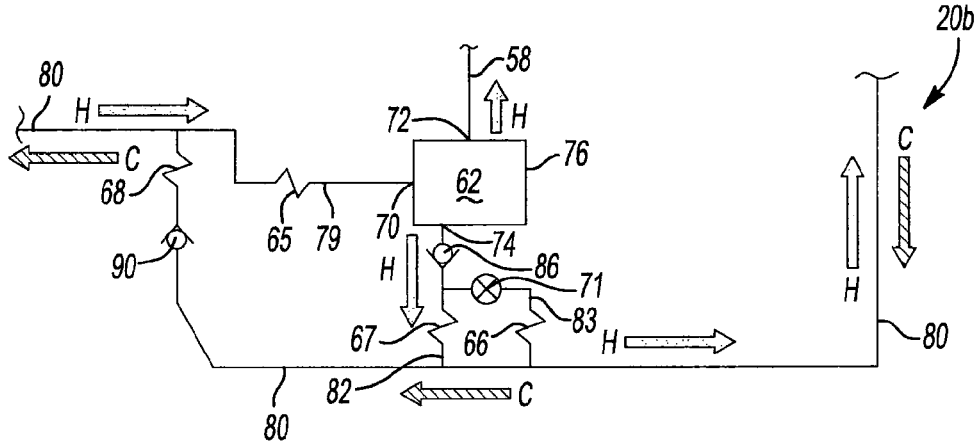
FIG. 5 is a schematic view of a vapor injection system in accordance with the principles of the present teachings for use with a heat pump system.

With reference to FIG. 5, a vapor injection system 20*b* is provided and may be used in place of the vapor injection system 20 shown in FIGS. 1-3. In view of the substantial similarity in structure and function of the components associated with the vapor injection system 20 with respect to the vapor injection system 20*b*, like reference numerals are used hereinafter and in the drawings to identify like components while like reference numerals containing letter extensions are used to identify those components that have been modified.

Vapor injection system 20*b* includes solenoid valve 71 and capillary tubes 66, 67 disposed proximate to outlet 74 of the flash tank 62. In addition, capillary tube 65 disposed proximate to inlet 70 of the flash tank 62. Refrigerant passing through capillary tube 65 is expanded prior to entering the flash tank 62 to help facilitate vaporization while refrigerant passing through capillary tubes 66, 67 is expanded to begin the transition from liquid to vapor to aid in the ability of the refrigerant to absorb heat at the first heat exchanger 22.

The vapor injection system 20*b* provides two modes of operation. First, when outdoor ambient conditions are high (i.e., when less heat is required indoor), solenoid valve 71 may be toggled into the open state to allow refrigerant to encounter capillary tube 66. When refrigerant is permitted to encounter capillary tube 66, refrigerant flows through conduits 82, 83 and into conduit 80 prior to reaching the first heat exchanger 22. By allowing refrigerant to flow through both capillary tubes 66, 67, the pressure of the refrigerant is increased and a greater volume of refrigerant reaches the first heat exchanger 22. The increased pressure of the refrigerant reduces the ability of the system to heat.

Second, when outdoor ambient conditions are low (i.e., when more heat is required indoor), solenoid valve 71 may be toggled into the closed state to restrict refrigerant from reaching capillary tube 66. By restricting refrigerant from flowing through capillary tube 66, the pressure of the refrigerant is reduced and the ability of the system to heat is increased. Therefore, controlling the solenoid valve 71 between the open and closed states provides the vapor injection system 20*b* with the ability to adjust to fluctuating outdoor ambient conditions.

Again, it should be noted that in a system using the vapor injection system 20*b* during the COOL mode and bypassing the vapor injection system 20*b* during the HEAT mode, that the solenoid valve 71 would be open when outdoor ambient conditions are low (i.e., when less cooling effect is required indoor) to decrease the ability of the heat pump system to cool. Conversely, in such a system, the solenoid valve 71 would be closed when outdoor ambient conditions are high (i.e., when a greater cooling effect is required indoor) to increase the ability of the heat pump system to cool.

Figure 6:
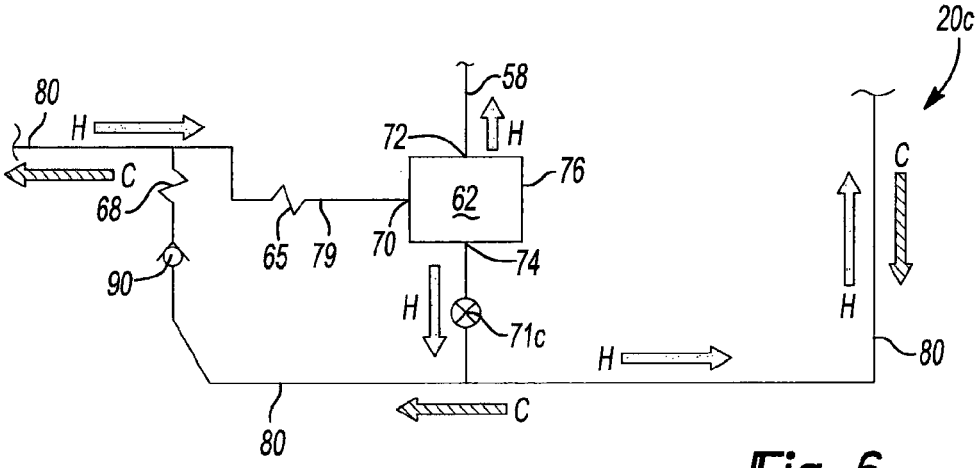
FIG. 6 is a schematic view of a vapor injection system in accordance with the principles of the present teachings for use with a heat pump system.

With reference to FIG. 6, a vapor injection system 20*c* is provided and may be used in place of the vapor injection system 20 shown in FIGS. 1-3. In view of the substantial similarity in structure and function of the components associated with the vapor injection system 20 with respect to the vapor injection system 20*c*, like reference numerals are used hereinafter and in the drawings to identify like components while like reference numerals containing letter extensions are used to identify those components that have been modified.

Vapor injection system 20*c* includes capillary tube 65 disposed proximate to inlet 70 of the flash tank 62. Refrigerant passing through capillary tube 65 is expanded prior to entering the flash tank 62 to help facilitate vaporization. In addition, vapor injection system 20*c* also includes a solenoid valve such as an electronic expansion valve 71*c* disposed proximate to outlet 74 of the flash tank 62. The expansion valve 71*c* regulates flow out of the flash tank 62 by controlling an opening between zero and one-hundred percent. While an electronic expansion valve 71*c* is disclosed, it should be understood that any valve capable of regulating flow, such as a thermal expansion valve, could alternatively be used.

The electronic expansion valve 71*c* may control vapor injection into the compressor 16 by controlling a volume of sub-cooled liquid refrigerant exiting the flash tank at outlet 74. When the electronic expansion valve 71*c* is fully closed (i.e., zero percent open), sub-cooled liquid refrigerant is not permitted to exit the flash tank 62 and, thus, the flash tank 62 cannot accept an influx of refrigerant at inlet 70. Under such conditions, refrigerant is not expanded within the flash tank 62 and is therefore not available for use by the compressor 16.

When the electronic expansion valve 71*c* is in a fully-open state (i.e., one-hundred percent open), sub-cooled liquid refrigerant is permitted to exit the flash tank 62 at outlet 74 and flow to the first heat exchanger 22. When sub-cooled liquid refrigerant is permitted to exit the flash tank 62, refrigerant is permitted to enter the flash tank 62 at inlet 70 and may therefore be expanded into a vapor for use by the compressor 16. Therefore, the vapor injection system 20*c* may be used to control the ability of the system to heat by controlling the state of electronic expansion valve 71*c*.

When ambient outdoor conditions are low, such that additional heating is required, the electronic expansion valve 71*c* is actuated into a position to reduce refrigerant flow (i.e., creates a smaller opening between outlet 74 and conduit 80). Reducing refrigerant flow through outlet 74 decreases the pressure of the refrigerant and therefore increases the ability of the system to heat. Conversely, when outdoor conditions are high, such that additional heating is not required, the electronic expansion valve 71*c* is opened to allow more refrigerant to flow through outlet 74 and to increase the pressure of the refrigerant. Increasing the pressure of the refrigerant decreases the ability of the system to heat.

It should be noted that in a system using the vapor injection system 20*c* during the COOL mode and bypassing the vapor injection system 20*c* during the HEAT mode, that the electronic expansion valve 71*c* would be open when outdoor ambient conditions are low (i.e., when less cooling effect is required indoor) to decrease the ability of the heat pump system to cool. Similarly, in such a system, the electronic expansion valve 71*c* would be partially closed when outdoor ambient conditions are high (i.e., when a greater cooling effect is required indoor) to increase the ability of the heat pump system to cool.

Each of the vapor injection systems 20, 20*a*, 20*b*, 20*c* may be used to regulate refrigerant flowing through the flash tank 62 to tailor the ability of the heat pump system 10 to heat based on outdoor ambient conditions. Similarly, each of the vapor injection systems 20, 20*a*, 20*b*, 20*c* may be used to regulate refrigerant flowing through the flash tank 62 to tailor the ability of the heat pump system 10 to cool based on outdoor ambient conditions when the flash tank 62 is bypassed during a HEAT mode.

The description of the teachings is merely exemplary in nature and, thus, variations that do not depart from the gist of the teachings are intended to be within the scope of the teachings. Such variations are not to be regarded as a departure from the spirit and scope of the teachings.

What is claimed is:

1. A heat pump system comprising:

a compressor;

a first heat exchanger in fluid communication with said compressor;

a second heat exchanger in fluid communication with said first heat exchanger and said compressor;

a flash tank fluidly coupled to said first heat exchanger and said second heat exchanger;

a first conduit extending between said first heat exchanger and said second heat exchanger; and a valve associated with said first conduit and operable in an open state to permit flow along said first conduit between said first heat exchanger and said second heat exchanger to at least partially bypass said flash tank and operable in a closed state to prevent flow along said first conduit between said first heat exchanger and said second heat exchanger to direct flow into said flash tank, wherein the heat pump system is operable in a heating mode and a cooling mode; and wherein said valve is in said open state when the heat pump system is operating in said heating mode and an outdoor ambient temperature is high and is in said closed state when the heat pump system is operating in said heating mode and said outdoor ambient temperature is low.

2. The heat pump system of claim 1, wherein said valve is operable in said open state and said closed state when the heat pump system is in said heating mode or said cooling mode.

3. The heat pump system of claim 1, wherein said valve is in said open state when the heat pump system is operating in said cooling mode and an outdoor ambient temperature is low and is in said closed sate when the heat pump system is operating in said cooling mode and said outdoor ambient temperature is high.

4. The heat pump system of claim 1, further comprising a capillary tube disposed between said valve and an inlet of one of said first heat exchanger and said second heat exchanger.

5. The heat pump system of claim 1, further comprising a second conduit extending between one of said first heat exchanger and said second heat exchanger and an inlet of said flash tank.

6. The heat pump system of claim 5, wherein said second conduit fluidly couples an inlet of said flash tank to said first conduit to selectively deliver refrigerant to said flash tank from one of said first heat exchanger and said second heat exchanger.

7. The heat pump system of claim 6, wherein all refrigerant from said one of said first heat exchanger and said second heat exchanger is delivered to said flash tank via said second conduit when said valve is in said closed state.

8. The heat pump system of claim 6, wherein refrigerant flows into said flash tank via said second conduit and flows through said valve along said first conduit when said valve is in said open state.

9. In a heat pump system circulating refrigerant between a first heat exchanger and a second heat exchanger in a fluid circuit including a compressor, a vapor injection system comprising:

a flash tank;

a first conduit fluidly coupling an inlet of said flash tank to the first heat exchanger and the second heat exchanger and operable to deliver refrigerant to said flash tank from at least one of the first heat exchanger and the second heat exchanger;

a second conduit extending between the first heat exchanger and the second heat exchanger and operable to selectively deliver refrigerant from one of the first heat exchanger and the second heat exchanger to the other of the first heat exchanger and the second heat exchanger to at least partially bypass said flash tank; and a valve associated with said second conduit and operable between a closed state preventing flow between the first heat exchanger and the second heat exchanger along said second conduit and an open state permitting flow between the first heat exchanger and the second heat exchanger along said second conduit;

wherein said valve is in said open state when the heat pump system is operating in a heating mode and an outdoor ambient temperature is high and is in said closed state when the heat pump system is operating in said heating mode and said outdoor ambient temperature is low.

10. The vapor injection system of claim 9, further comprising a capillary tube disposed between said valve and an inlet of one of the first heat exchanger and the second heat exchanger.

11. The vapor injection system of claim 9, wherein all refrigerant from one of the first heat exchanger and the second heat exchanger is delivered to said flash tank via said first conduit when said valve is in said closed state.

12. The vapor injection system of claim 9, wherein said valve is in said open state when the heat pump system is operating in a cooling mode and an outdoor ambient temperature is low and is in said closed state when the heat pump system is operating in said cooling mode and said outdoor ambient temperature is high.

13. The vapor injection system of claim 9, wherein said valve is operable in said open state and said closed state when the heat pump system is operating in a heating mode or in a cooling mode.

14. A heat pump system comprising:

a compressor;

a first heat exchanger in fluid communication with said compressor;

a second heat exchanger in fluid communication with said first heat exchanger and said compressor;

a flash tank fluidly coupled to said first heat exchanger and said second heat exchanger;

a first conduit extending between said first heat exchanger and said second heat exchanger; and a valve associated with said first conduit and operable in an open state to permit flow along said first conduit between said first heat exchanger and said second heat exchanger to at least partially bypass said flash tank and operable in a closed state to prevent flow along said first conduit between said first heat exchanger and said second heat exchanger to direct flow into said flash tank, wherein the heat pump system is operable in a heating mode and a cooling mode; and wherein said valve is in said open state when the heat pump system if operating in said cooling mode and an outdoor ambient temperature is low and is in said closed sate when the heat pump system is operating in said cooling mode and said outdoor ambient temperature is high.

15. The heat pump system of claim 14, further comprising a second conduit extending between one of said first heat exchanger and said second heat exchanger and an inlet of said flash tank.

16. The heat pump system of claim 15, wherein said second conduit fluidly couples an inlet of said flash tank to said first conduit to selectively deliver refrigerant to said flash tank from one of said first heat exchanger and said second heat exchanger.

17. The heat pump system of claim 16, wherein all refrigerant from said one of said first heat exchanger and said second heat exchanger is delivered to said flash tank via said second conduit when said valve is in said closed state.

18. The heat pump system of claim 16, wherein refrigerant flows into said flash tank via said second conduit and flows through said valve along said first conduit when said valve is in said open state.

19. In a heat pump system circulating refrigerant between a first heat exchanger and a second heat exchanger in a fluid circuit including a compressor, a vapor injection system comprising:

a flash tank;

a first conduit fluidly coupling an inlet of said flash tank to the first heat exchanger and the second heat exchanger and operable to deliver refrigerant to said flash tank from at least one of the first heat exchanger and the second heat exchanger;

a second conduit extending between the first heat exchanger and the second heat exchanger and operable to selectively deliver refrigerant from one of the first heat exchanger and the second heat exchanger to the other of the first heat exchanger and the second heat exchanger to at least partially bypass said flash tank; and a valve associated with said second conduit and operable between a closed state preventing flow between the first heat exchanger and the second heat exchanger along said second conduit and an open state permitting flow between the first heat exchanger and the second heat exchanger along said second conduit;

wherein said valve is in said open state when the heat pump system is operating in a cooling mode and an outdoor ambient temperature is low and is in said closed state when the heat pump system is operating in said cooling mode and said outdoor ambient temperature is high.

20. The vapor injection system of claim 19, wherein all refrigerant from one of the first heat exchanger and the second heat exchanger is delivered to said flash tank via said first conduit when said valve is in said closed state.

21. The vapor injection system of claim 19, wherein said valve is operable in said open state and said closed state when the heat pump system is operating in a heating mode or in a cooling mode.

* * * * *